US006855035B2

(12) United States Patent
Homma et al.

(10) Patent No.: US 6,855,035 B2
(45) Date of Patent: Feb. 15, 2005

(54) APPARATUS AND METHOD FOR PRODUCING SUBSTRATE WITH ELECTRICAL WIRE THEREON

(75) Inventors: Yoshio Homma, Hinode (JP); Noriyuki Sakuma, Hachioji (JP); Naofumi Ohashi, Hanno (JP); Toshinori Imai, Ome (JP)

(73) Assignee: Renesas Technology Corp., Tokyo (JP)

( * ) Notice: Subject to any disclaimer, the term of this patent is extended or adjusted under 35 U.S.C. 154(b) by 20 days.

(21) Appl. No.: 10/214,369

(22) Filed: Aug. 8, 2002

(65) Prior Publication Data

US 2002/0193051 A1 Dec. 19, 2002

Related U.S. Application Data

(62) Division of application No. 09/558,593, filed on Apr. 26, 2000, now Pat. No. 6,561,875.

(30) Foreign Application Priority Data

Apr. 27, 1999 (JP) ..... 11-119189

(51) Int. Cl.[7] ..... B24B 1/00
(52) U.S. Cl. ..... 451/41; 451/287; 438/690
(58) Field of Search ..... 451/287, 41, 288; 438/690, 691, 692, 693, 745, 754

(56) References Cited

U.S. PATENT DOCUMENTS 5,049,221 A * 9/1991 Wada et al. ..... 156/151
5,597,341 A 1/1997 Kodera et al.
5,902,173 A 5/1999 Tanaka
6,117,775 A * 9/2000 Kondo et al. ..... 438/690
6,126,511 A 10/2000 Hayakawa et al.
6,171,180 B1 1/2001 Koutny, Jr. et al.
6,213,852 B1 4/2001 Fujii et al.
6,326,299 B1 * 12/2001 Homma et al. ..... 438/633
6,387,190 B1 * 5/2002 Aoki et al. ..... 134/28
6,475,909 B2 * 11/2002 Uozumi ..... 438/678
6,561,875 B1 * 5/2003 Homma et al. ..... 451/41
2001/0041446 A1 * 11/2001 Takahashi ..... 438/692
2003/0003713 A1 * 1/2003 Homma et al. ..... 438/633
2003/0159644 A1 * 8/2003 Yonehara et al. ..... 117/8

FOREIGN PATENT DOCUMENTS

JP 2-278822 11/1990
JP 8-64562 3/1996
JP 8-83780 3/1996
JP 9-306881 11/1997
JP 10-125880 5/1998

OTHER PUBLICATIONS

"A New Slurry–free CMP Technique for Cu Interconnects Published on Semi–Technology Symposium", 1998.

* cited by examiner

*Primary Examiner*—M. Rachuba
(74) *Attorney, Agent, or Firm*—Mattingly, Stanger & Malur, P.C.

(57) ABSTRACT

The apparatus and method for producing a substrate having a substrate surface by polishing the substrate surface, which includes a metallic wire.

A polishing liquid is supplied a clearance between the substrate surface and the surface of a polishing pad. The polishing liquid includes an acid which dissolves the oxidized part of the substrate surface and is substantially free of solid abrasive powder.

A relative movement is generated between the substrate surface and the polishing pad surface while the substrate surface is pressed against the polishing pad surface while the polishing liquid is supplied so that the dissolved oxidized part of the substrate surface can be removed from the substrate.

42 Claims, 5 Drawing Sheets

APPARATUS AND METHOD FOR PRODUCING SUBSTRATE WITH ELECTRICAL WIRE THEREON

This is a divisional application of U.S. Ser. No. 09/558,593, filed Apr. 26, 2000 now U.S. Pat No. 6,561,875.

BACKGROUND OF THE INVENTION AND RELATED ART STATEMENT

The present invention relates to a method and apparatus for producing a substrate whose surface includes a metallic wire, by polishing the substrate surface.

JP-A-2-278822 discloses a polishing method using a polishing liquid including an etching liquid and abrasive power to polish a substrate chemically and mechanically. JP-A-8-83780 discloses a polishing method using a polishing liquid including an etching liquid to polish a substrate chemically and mechanically. JP-A-9-306881 discloses a polishing method using a polishing liquid including an etching liquid without abrasive powder to polish a substrate chemically and mechanically. JP-A-10-125880 discloses a polishing method using a polishing liquid including an alkaline etching liquid without abrasive powder to polish a substrate chemically and mechanically. JP-A-8-64562 and A new Slurry-free CMP Technique for Cu Interconnects published on Semi-Technology Symposium 1998 disclose a polishing method using a polishing pad including abrasive powder and a polishing liquid without abrasive powder to polish a substrate. The publication of U.S. Pat. No. 5,597,341 discloses a structure for detecting a frictional force between a polishing pad and a substrate during polishing by measuring a polishing pad rotational driving force and a substrate rotational driving force.

OBJECT AND SUMMARY OF THE INVENTION

An object of the present invention is to provide a method and apparatus for producing a substrate whose surface includes a metallic wire by polishing the substrate surface, in which method and apparatus a decrease of a frictional coefficient between a substrate surface and a polishing pad surface or a polishing depth increasing velocity in accordance with an increase of a relative movement velocity between the polishing pad surface and the substrate surface to be polished by the polishing pad surface is restrained. The frictional coefficient between the substrate surface and the polishing pad surface is determined in the present invention as (a measured frictional force therebetween/a pressing force applied therebetween).

In the present invention for producing a substrate whose surface includes a metallic wire by polishing the substrate surface, a polishing liquid is supplied into a clearance between the substrate surface and a polishing pad surface of a polishing pad, which polishing liquid includes an acid for dissolving an oxidized part of the substrate surface and is prevented substantially from including solid abrasive powder, and a relative movement is generated between the substrate surface and the polishing pad surface while pressing the substrate surface against the polishing pad surface with the polishing liquid between the substrate surface and the polishing pad surface so that the dissolved oxidized part of the substrate surface is removed from the substrate.

Since the polishing liquid which includes the acid for dissolving the oxidized part of the substrate surface and is prevented substantially from including solid abrasive powder is used to polish the substrate surface, a viscosity of the polishing liquid is kept small while preventing an increase in number of defects on the substrate surface by the abrasive powder so that the decrease of the frictional coefficient between the substrate surface and the polishing pad surface or a polishing depth increasing velocity in accordance with an increase of a relative movement velocity between a polishing pad surface and the substrate surface to be polished by the polishing pad surface is restrained. The polishing liquid may further include an oxidizing agent (including, for example, hydrogen peroxide, phosphoric acid, nitric acid, or the like) for oxidizing a part of the substrate surface so that the part of the substrate surface becomes brittle, a protective film forming agent (including, for example, benzotriazole (BTA), a derivative of benzotriazole or the like) for forming a protective film on the substrate surface so that an oxidizing proceeding on a bottom part of a substrate surface micro-shape of roughness by the oxidizing agent is restrained, and a surfactant for chemical stability of the polishing liquid. A main component of the polishing pad is, for example, foamed polyurethane polymer, foamed fluorocarbon polymer or the like.

If the oxidized part of the substrate surface is dissolved in the polishing liquid, and the polishing liquid in which a concentration of the dissolved oxidized part of the substrate surface is smaller than a concentration of the dissolved oxidized part of the substrate surface in the polishing liquid on the polishing pad surface is added and supplied into the polishing liquid on the polishing pad surface so that a concentration of the dissolved oxidized part of the substrate surface in the polishing liquid to be supplied to the clearance between the substrate surface and the polishing pad surface is decreased, a dissolution, diffusion or removal of the oxidized part of the substrate surface from the polishing pad surface and/or the substrate is accelerated so that a decrease of frictional coefficient between the polishing pad surface and the substrate surface or of polishing depth increasing velocity is restrained although a floating force between the substrate surface and the polishing pad surface increases in accordance with the increase of relative movement velocity between the polishing pad surface and the substrate surface.

If the relative movement between the substrate surface and the polishing pad surface is being generated when the polishing liquid in which the concentration of the dissolved oxidized part of the substrate surface is smaller than the concentration of the dissolved oxidized part of the substrate surface in the polishing liquid on the polishing pad surface is added and supplied into the polishing liquid on the polishing pad surface, both of the supply of the polishing liquid in which the concentration of the dissolved oxidized part of the substrate surface is smaller than the concentration of the dissolved oxidized part of the substrate surface in the polishing liquid on the polishing pad surface into the polishing liquid on the polishing pad surface and the removal of the oxidized part of the substrate surface from the substrate surface and/or polishing pad surface are simultaneously performed with the relative movement so that the dissolution, diffusion or removal of the oxidized part of the substrate surface from the polishing pad surface and/or the substrate is accelerated to restrain the decrease of frictional coefficient between the polishing pad surface and the substrate surface or of polishing depth increasing velocity.

If the substrate surface is prevented from contacting the polishing pad surface when the polishing liquid in which the concentration of the dissolved oxidized part of the substrate surface is smaller than the concentration of the dissolved oxidized part of the substrate surface in the polishing liquid on the polishing pad surface is added and supplied into the polishing liquid on the polishing pad surface, the concentration of the dissolved oxidized part of the substrate surface is effectively decreased over a large area of the polishing pad surface without being obstructed by the substrate surface.

It is effective for decreasing the concentration of the dissolved oxidized part of the substrate surface in the polishing liquid on the polishing pad surface that the polishing liquid in which the concentration of the dissolved oxidized part of the substrate surface is smaller than the concentration of the dissolved oxidized part of the substrate surface in the polishing liquid on the polishing pad surface is prevented substantially from including the dissolved oxidized part of the substrate surface.

If the polishing liquid is stirred in a direction perpendicular to a direction of the relative movement so that the concentration of dissolved oxidized part of the substrate surface in the polishing liquid is made uniform in the direction perpendicular to the direction of the relative movement, the removal of the oxidized part of the substrate surface from the polishing pad surface and/or the substrate is uniformly performed in the direction perpendicular to the direction of the relative movement so that the decrease of frictional coefficient between the polishing pad surface and the substrate surface or of polishing depth increasing velocity is restrained. When the polishing pad rotates on a rotational axis, and a stirring member slides radially inward on the polishing pad surface, a discharge of the polishing liquid from the polishing pad surface by a centrifugal force is restrained. When the polishing pad rotates on the rotational axis, and the stirring member slides radially outward on the polishing pad surface, a discharge of the polishing liquid in which the concentration of the dissolved oxidized part of the substrate surface is large from the polishing pad surface is accelerated. The polishing liquid may be stirred while the substrate surface contacts the polishing pad surface to polish the substrate surface or while the substrate surface is prevented from contacting the polishing pad surface.

If the polishing liquid whose acidity is larger than an acidity of the polishing liquid on the polishing pad surface is added and supplied into the polishing liquid on the polishing pad surface so that the acidity of the polishing liquid to be supplied to the clearance between the substrate surface and the polishing pad surface is increased, the dissolution, diffusion or removal of the oxidized part of the substrate surface from the polishing pad surface and/or the substrate is accelerated so that the decrease of frictional coefficient between the polishing pad surface and the substrate surface or of polishing depth increasing velocity is restrained although the floating force between the substrate surface and the polishing pad surface increases in accordance with the increase of relative movement velocity between the polishing pad surface and the substrate surface.

As shown in FIG. 4*b,* during the polishing with the polishing liquid including the acid for dissolving the oxidized part of the substrate surface, the decrease of frictional coefficient between the polishing pad surface and the substrate surface or of polishing depth increasing velocity is small at a relatively low velocity of the relative movement although the polishing is continued for a relatively long time, on the other hand, the frictional coefficient between the polishing pad surface and the substrate surface or the polishing depth increasing velocity decreases abruptly at a relatively high velocity of the relative movement when the polishing has been continued for the relatively long time (for example, 1–5 minutes). As shown in FIG. 4*a* showing a relationship between the velocity of the relative movement and the frictional force between polishing pad surface and the substrate surface measured when the polishing has been continued for the relatively long time (for example, 1–5 minutes), the frictional coefficient between the polishing pad surface and the substrate surface or the polishing depth increasing velocity is large at the relatively low velocity of the relative movement lower than a critical relative movement velocity range, the frictional coefficient between the polishing pad surface and the substrate surface or the polishing depth increasing velocity is low at the relatively high velocity of the relative movement higher than the critical relative movement velocity range, and a change between the frictional force or polishing depth increasing velocity at the relatively low velocity and the frictional force or polishing depth increasing velocity at the relatively high velocity is critical. In the present invention, by at least one of supplying additionally the polishing liquid in which the concentration of the dissolved oxidized part of the substrate surface is smaller than the concentration of the dissolved oxidized part of the substrate surface in the polishing liquid on the polishing pad surface into the polishing liquid on the polishing pad surface so that the concentration of the dissolved oxidized part of the substrate surface in the polishing liquid to be supplied to the clearance between the substrate surface and the polishing pad surface is decreased, supplying additionally the polishing liquid whose acidity is larger than the acidity of the polishing liquid on the polishing pad surface into the polishing liquid on the polishing pad surface so that the acidity of the polishing liquid to be supplied to the clearance between the substrate surface and the polishing pad surface is increased, and supplying additionally a surfactant into the polishing liquid on the polishing pad surface so that the volume of the surfactant on the polishing pad surface is increased, the dissolution, diffusion or removal of the oxidized part of the substrate surface from the polishing pad surface and/or the substrate is accelerated so that the frictional force or polishing depth increasing velocity is prevented from changing abruptly and critically at the critical relative movement velocity range.

If the relative movement between the substrate surface and the polishing pad surface is being generated when the polishing liquid whose acidity is larger than the acidity of the polishing liquid on the polishing pad surface is added and supplied into the polishing liquid on the polishing pad surface, both of the supply of the polishing liquid whose acidity is larger than the acidity of the polishing liquid on the polishing pad surface into the polishing liquid on the polishing pad surface and the removal of the oxidized part of the substrate surface from the substrate surface and/or polishing pad surface are simultaneously performed with the relative movement so that the dissolution, diffusion or removal of the oxidized part of the substrate surface from the polishing pad surface and/or the substrate is accelerated to restrain the decrease of frictional coefficient between the polishing pad surface and the substrate surface or of polishing depth increasing velocity.

If the substrate surface is prevented from contacting the polishing pad surface when the polishing liquid whose acidity is larger than the acidity of the polishing liquid on the polishing pad surface is added and supplied into the polishing liquid on the polishing pad surface, the acidity in the polishing liquid is effectively increased over the large area of the polishing pad surface without being obstructed by the substrate surface.

It is preferable that the polishing liquid whose acidity is larger than the acidity of the polishing liquid on the polishing pad surface is prevented substantially from including the dissolved oxidized part of the substrate surface. If the polishing liquid is stirred in a direction perpendicular to a direction of the relative movement so that the acidity of the polishing liquid is made uniform in the direction perpendicular to the direction of the relative movement, the removal of the oxidized part of the substrate surface from the polishing pad surface and/or the substrate is uniformly performed in the direction perpendicular to the direction of the relative movement so that the decrease of frictional coefficient between the polishing pad surface and the substrate surface or of polishing depth increasing velocity is restrained.

A stirring member may grind the polishing pad surface when the stirring member slides on the polishing pad surface to stir the polishing liquid. The stirring member may be prevented substantially from grinding the polishing pad surface when the stirring member slides on the polishing pad surface to stir the polishing liquid.

If the polishing liquid in which the concentration of the dissolved oxidized part of the substrate surface is smaller than the concentration of the dissolved oxidized part of the substrate surface in the polishing liquid on the polishing pad surface is supplied into the clearance between the substrate surface and the polishing pad surface after being stirred by the stirring member to be mixed with the polishing liquid on the polishing pad surface, the polishing liquid in which the concentration of the dissolved oxidized part of the substrate surface is small and constant is supplied into the clearance between the substrate surface and the polishing pad surface. If the polishing liquid in which the concentration of the dissolved oxidized part of the substrate surface is smaller than the concentration of the dissolved oxidized part of the substrate surface in the polishing liquid on the polishing pad surface is supplied into the clearance between the substrate surface and the polishing pad surface before being stirred by the stirring member and subsequently is stirred by the stirring member to be mixed with the polishing liquid on the polishing pad surface after passing through the clearance between the substrate surface and the polishing pad surface, the polishing liquid in which the concentration of the dissolved oxidized part of the substrate surface is small is effectively supplied into the clearance between the substrate surface and the polishing pad surface.

If the polishing liquid whose acidity is larger than the acidity of the polishing liquid on the polishing pad surface is supplied into the clearance between the substrate surface and the polishing pad surface after being stirred by the stirring member to be mixed with the polishing liquid on the polishing pad surface, the polishing liquid whose acidity is large and constant therein is supplied into the clearance between the substrate surface and the polishing pad surface. If the polishing liquid whose acidity is larger than the acidity of the polishing liquid on the polishing pad surface is supplied into the clearance between the substrate surface and the polishing pad surface before being stirred by the stirring member and subsequently is stirred by the stirring member to be mixed with the polishing liquid on the polishing pad surface after passing through the clearance between the substrate surface and the polishing pad surface, the polishing liquid whose acidity is large is effectively supplied into the clearance between the substrate surface and the polishing pad surface.

It is preferable for finely finishing a roughness of the substrate surface that, during the relative movement, a pressing force between the polishing pad surface and the substrate surface is limited to such a degree that the polishing pad surface is prevented from removing from the substrate the oxidized part of solid state which is undissolved by the acid and the oxidized part is dissolved by the acid in the polishing liquid on the polishing pad surface after being removed from the substrate so that the oxidized part of the substrate surface is prevented from being included by the polishing liquid on the polishing pad surface in a solid state. The degree of the pressing force between the polishing pad surface and the substrate surface for preventing the polishing pad surface from removing from the substrate the oxidized part of solid state which is undissolved by the acid is determined experimentally and/or experientially.

If a frictional force between the substrate surface and the polishing pad surface is measured to detect a decrease of the frictional force (for example, decrease from a desired frictional force by 10%) and the pressing force of the substrate surface against the polishing pad surface and/or a pressing force of the stirring member or a dressing member for cutting the polishing pad surface to roughen the polishing pad surface against the polishing pad surface is increased in response to the detected decrease of the frictional force so that the decrease of the frictional force is restrained, the decrease of polishing depth increasing velocity is restrained. If the velocity of the relative movement between the substrate surface and the polishing pad surface is decreased in response to the detected decrease of the frictional force so that the decrease of the frictional force is restrained, the decrease of polishing depth increasing velocity is restrained. The oxidized part of the substrate surface includes an oxidized metallic component. The polishing liquid may include the abrasive powder of not more than 0.5 weight percent, preferably not more than 0.1 weight percent.

If a surfactant (sulfonate type or polyacrylate type, for example, poly-ammonium-acrylate, poly-ammonium-methacrylate, benzene-ammonium-sulfonate, benzene-potassium-sulfonate or the like) is added and supplied into the polishing liquid on the polishing pad surface so that a volume of the surfactant on the polishing pad surface is increased and bubbles of the polishing liquid are generated or the generation of the bubbles of the polishing liquid is accelerated on the polishing pad surface, the dissolution or removal of the oxidized part of the substrate surface from the polishing pad surface and/or the substrate and/or the diffusion of the dissolved oxidized part of the substrate surface in the polishing liquid is accelerated so that the frictional force or polishing depth increasing velocity is prevented from changing abruptly and critically at the critical relative movement velocity range. If the relative movement between the substrate surface and the polishing pad surface is being generated when the surfactant is added and supplied into the polishing liquid on the polishing pad surface, the removal of the dissolved oxidized part of the substrate surface from the polishing pad surface and/or the substrate is accelerated by the surfactant. If the substrate surface is prevented from contacting the polishing pad surface when the surfactant is added and supplied into the polishing liquid on the polishing pad surface, the diffusion of the dissolved oxidized part of the substrate surface in the polishing liquid is accelerated on most of the polishing pad surface. If the surfactant is supplied into the clearance between the substrate surface and the polishing pad surface after being stirred by the stirring member to be mixed with the polishing liquid on the polishing pad surface, the polishing liquid in which the surfactant is uniformly distributed is supplied into the clearance between the substrate surface and the polishing pad surface so that the oxidized part of the substrate surface is removed uniformly between the substrate surface and the polishing pad surface. If the surfactant is supplied into the clearance between the substrate surface and the polishing pad surface before being stirred by the stirring member and subsequently is stirred by the stirring member to be mixed with the polishing liquid on the polishing pad surface after passing through the clearance between the substrate surface and the polishing pad surface, the removal of the dissolved oxidized part of the substrate surface from the substrate surface and/or the polishing pad surface is surface is accelerated.

If a frictional force between the stirring member or the dressing member and the polishing pad surface is measured to detect a decrease of the frictional force (for example, decrease from a desired frictional force by 20%) and the pressing force of the stirring member or dressing member against the polishing pad surface and/or the pressing force of the substrate surface against the polishing pad surface is increased in response to the detected decrease of the frictional force so that the decrease of the frictional force is restrained, the decrease of polishing depth increasing velocity is restrained. If the velocity of the relative movement between the substrate surface and the polishing pad surface is decreased in response to the detected decrease of the frictional force so that the decrease of the frictional force is restrained, the decrease of polishing depth increasing velocity is restrained.

DETAILED DESCRIPTION OF PREFERRED EMBODIMENTS

Embodiment 1

Figure 1A:
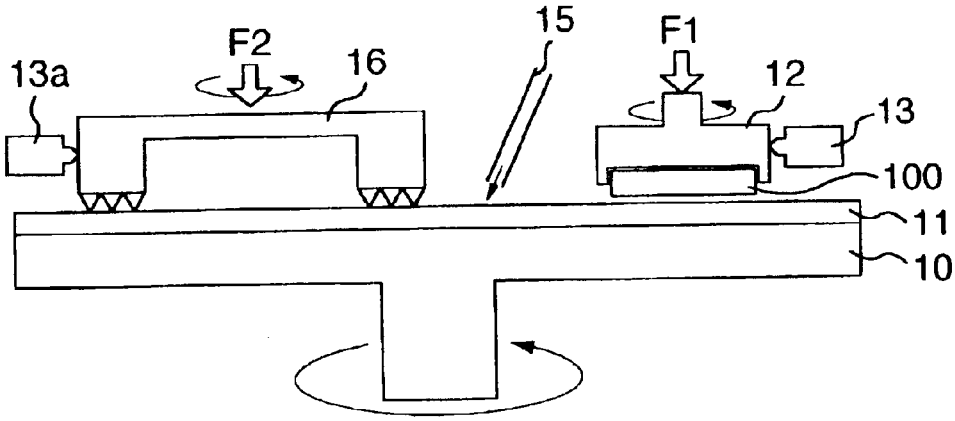
FIG. 1*a* is a cross-sectional view showing a polishing apparatus usable for carrying out the present invention.

As shown in FIG. 1, a polishing apparatus includes a rotatable platen 10 of for example, 18 inches outer diameter as the claimed polishing pad holder onto which a polishing pad 11 is fixed, and a polishing liquid supplier 15 from which an abrasive-grain-free polishing liquid (not-shown) which is prevented substantially from including abrasive solid power is supplied onto a polishing pad surface of the polishing pad 11. A substrate 100 which is a silicon wafer of 4 inches outer diameter including Cu wires of 1 $\mu$m thickness on a surface thereof is held by a carrier 12 to be pressed against the polishing pad surface of the polishing pad 11. A force measuring sensor 13 (for example, load cell LM-A of Product of Kyouwa-dengyo Inc.,) for measuring a frictional force between the substrate 100 and the polishing pad 11 is arranged at a downstream side of the carrier 12 in the tangential moving direction of the rotatable platen 10. A rotational dressing tool 16 (for example, PCR-103 of Product of Nanofactor Inc.,) (as the claimed stirring member) is adapted to be pressed against the polishing pad surface while rotating, and includes a ring-shaped stainless dressing surface in which diamond grains are embedded. The abrasive-grain-free polishing liquid including for example, malic acid for dissolving an oxidized layer, BTA for forming a protective layer on the oxidized layer, hydrogen peroxide for oxidizing a surface of the substrate and a surfactant for chemical stability is supplied onto the polishing pad surface by 50 ml/minute.

When the substrate surface is polished under a pressure of 200 gf/cm$^2$ between the polishing pad surface and the substrate surface and a pressure of 110 gf/cm$^2$ between the dressing tool 16 and the polishing pad surface during in-situ (simultaneous with polishing) dressing while the platen is rotated at each of 30 rpm and 90 rpm, the frictional force is 68 gf/cm$^2$ at 30 rpm and 58 gf/cm$^2$ at 90 rpm, and a polishing depth increasing rate or velocity is about 160 nm/minute at each of 30 rpm and 90 rpm. They does not change significantly when the elapsed time after start of polishing increases from 1 minute to 5 minutes.

When the polishing is performed without the dressing by the dressing tool 16 after ex-situ (non-simultaneous with polishing operation) dressing with dressing by the dressing tool 16 and water under the pressure of 110 gf/cm$^2$ between the dressing tool 16 and the polishing pad surface under the same conditions as the above conditions, the polishing depth increasing rate at 30 rpm is kept about 160 nm/minute irrespective of the elapsed time, but the polishing depth increasing rate at 90 rpm decreases from about 150 nm/minute to about 50 nm/minute in accordance with an increase of the elapsed time from 1 minute to 5 minutes.

Embodiment 2

Figure 2:
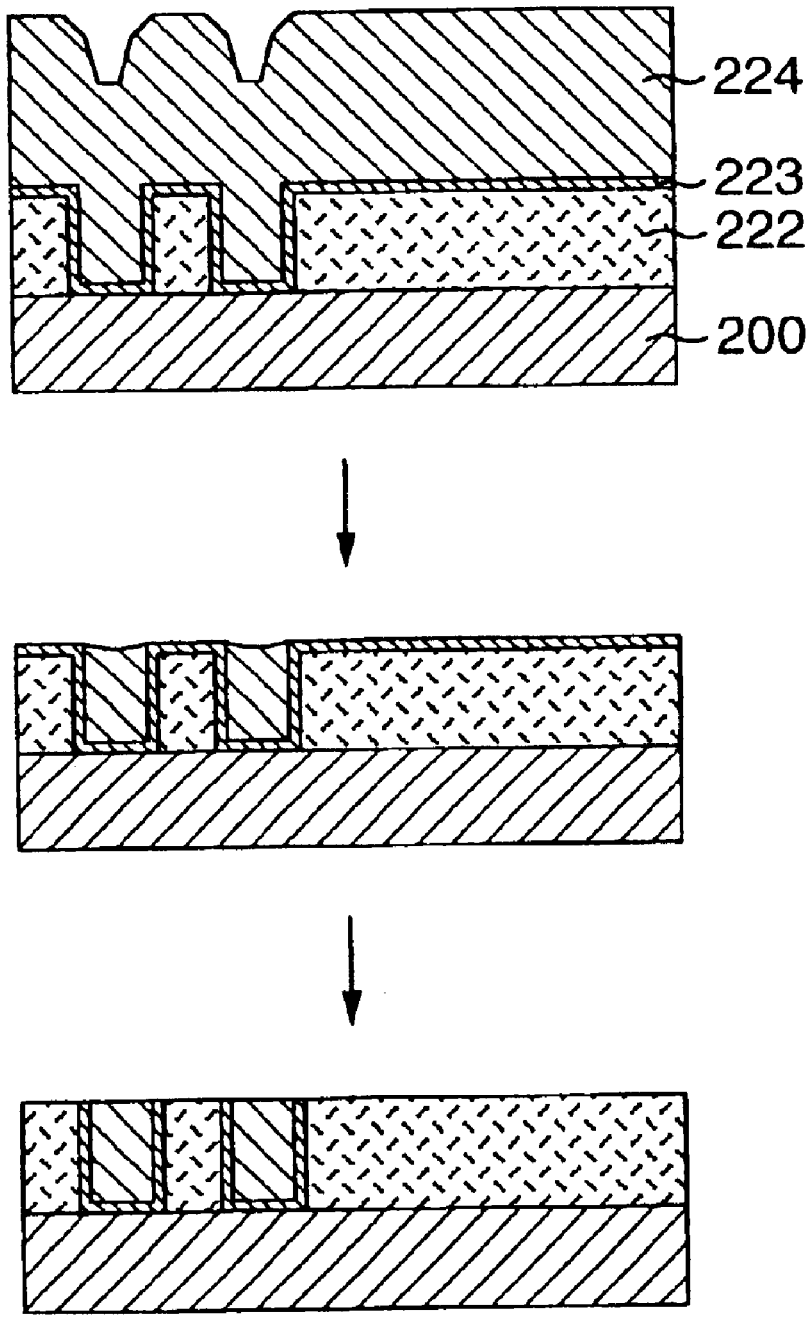
FIG. 2 is a proceeding of polishing on a substrate with electric wires thereon.

A substrate of 6-inches silicon wafer is polished as shown in FIG. 2 by the above described apparatus with the in-situ dressing. In the substrate to be polished, grooves for receiving metallic wires are formed in a first isolating layer 222 of 0.5 $\mu$m thickness silicon oxide on a substrate base 200, a first metallic lower coating layer 223 of 0.5 nm thickness titan nitride is deposited on the first isolating layer 222 and in the grooves through a publicly known reactive sputtering, a first metallic upper coating layer 224 of 80 nm thickness of Cu is deposited on the first metallic lower coating layer 223, and the first metallic upper coating layer 224 is heated to flow into the grooves. By polishing the substrate surface on the platen 10 while supplying the abrasive-powder-free polishing liquid from the polishing liquid supplier 15 under the pressure of 200 gf/cm$^2$ between the substrate surface and the polishing pad surface at 30 rpm of the platen rotation, the first metallic upper coating layer 224 on an area other than the grooves is removed substantially completely at the polishing depth increasing rate of about 155 nm/minute, but the first metallic lower coating layer 223 remains on the substrate.

When the first metallic upper coating layer 224 is removed substantially completely on the area other than the grooves, a completion of the polishing is detected in response to an abrupt decrease of the frictional force decreases from 65 gf/cm$^2$ to 30 gf/cm$^2$. Additional or excessive polishing for 4 minutes corresponding to 20% of a measured time period for the complete removal by polishing of the first metallic upper coating layer 224 on the area other than the grooves is performed.

Thereafter, on another polishing apparatus, the first metallic lower coating layer 223 is removed by the polishing. A polishing agent is made by forming a mixture of alumina-abrasive-powder type polishing agent of QCTT1010 (product of Rodel Co., ) and an aqueous solution of 7.3% hydrogen peroxide with a volume ratio 1:3, and adding thereto an aqueous solution of BTA of 2 wt % to make a solution of 0.1 wt % alumina-abrasive-powder type polishing agent. The made polishing agent is supplied onto the polishing pad surface by 0.1 liter/minute. Although the QCTT1010 alumina-abrasive-powder type polishing agent is suitable for polishing Cu, the polishing depth increasing rate through Cu is prevented because of BTA from decreasing to not more than 20 nm/minute, while preventing etching of Cu. On the other hand, the polishing depth increasing rate through titan nitride is kept about 50 nm/minute although BTA is added. Therefore, the first metallic lower coating layer 223 on the area other than the grooves is removed completely while the first metallic upper coating layer 224 in the grooves is prevented substantially from being removed. Since a ratio between the polishing depth increasing rate through the first metallic lower coating layer 223 and the polishing depth increasing rate through the first isolating layer 222 is 10:1, a termination of the polishing can be determined in response to the predetermined elapsed time of polishing without measuring the frictional force.

Embodiment 3

Figure 5:
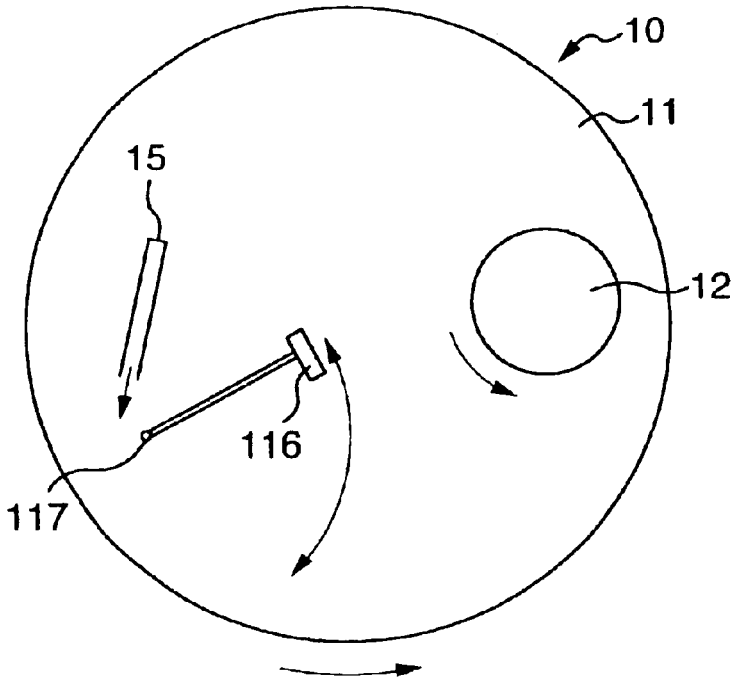
FIG. 5 is a front view showing another polishing apparatus usable for carrying out the present invention.

In another polishing apparatus shown in FIG. 5, a brush 116 (as the claimed stirring member) including slide nylon filaments of 0.15 mm diameter is used instead of the dressing tool 16. The abrasive-grain-free polishing liquid after being supplied from the polishing liquid supplier 15 is stirred by the brush 116 sliding on the polishing pad 11 and subsequently proceeds into the clearance between the polishing pad 11 and the substrate surface to be polished under the carrier 12 during the polishing. The brush 116 swings (partially orbits) around a swing axis 117 to reciprocate (30 times/minute) in a sliding manner on the polishing pad surface radially inward and outward during the polishing. If the brush 116 swings and slides on the polishing pad surface when the substrate is prevented from contacting the polishing pad surface and the polishing pad 11 is rotated, a water is supplied instead of the polishing liquid. The other polishing conditions are the same as those of the example 2.

By polishing the substrate surface on the platen 10 while supplying the abrasive-powder-free polishing liquid from the polishing liquid supplier 15 under the pressure of 200 gf/cm$^2$ between the substrate surface and the polishing pad surface at 60 rpm of the platen rotation, the first metallic upper coating layer 224 on the area other than the grooves is removed substantially completely at the polishing depth increasing rate of about 150–155 nm/minute, but the first metallic lower coating layer 223 remains on the substrate.

When the first metallic upper coating layer 224 is removed substantially completely on the area other than the grooves, the completion of the polishing is detected in response to an abrupt decrease of the frictional force decreases from 60 gf/cm$^2$ to 30 gf/cm$^2$. Additional or excessive polishing for 4 minutes corresponding to 20% of a measured time period for the complete removal by polishing of the first metallic upper coating layer 224 on the area other than the grooves is performed.

Thereafter, on another polishing apparatus, the first metallic lower coating layer 223 is removed by the polishing. A polishing agent is made by forming a mixture of alumina-abrasive-powder type polishing agent of QCTT1010 (product of Rodel Co.,) and an aqueous solution of 7.3% hydrogen peroxide with a volume ratio 1:3, and adding thereto an aqueous solution of BTA of 2 wt % to make a solution of 0.1 wt % alumina-abrasive-powder type polishing agent. The made polishing agent is supplied onto the polishing pad surface by 0.1 liter/minute. During this polishing, the same dressing tool 16 as the first embodiment is pressed against the polishing pad surface under 110 gf/cm$^2$ for in-situ dressing. Although the QCTT1010 alumina-abrasive-powder type polishing agent is suitable for polishing Cu, the polishing depth increasing rate through Cu is prevented because of BTA from decreasing to not more than 20 nm/minute, while preventing etching of Cu. On the other hand, the polishing depth increasing rate through titan nitride is kept about 50 nm/minute although BTA is added. Therefore, the first metallic lower coating layer 223 on the area other than the grooves is removed completely while the first metallic upper coating layer 224 in the grooves is prevented substantially from being removed. Since a ratio between the polishing depth increasing rate through the first metallic lower coating layer 223 and the polishing depth increasing rate through the first isolating layer 222 is 10:1, a termination of the polishing can be determined in response to the predetermined elapsed time of polishing without measuring the frictional force.

Embodiment 4

Figure 3:
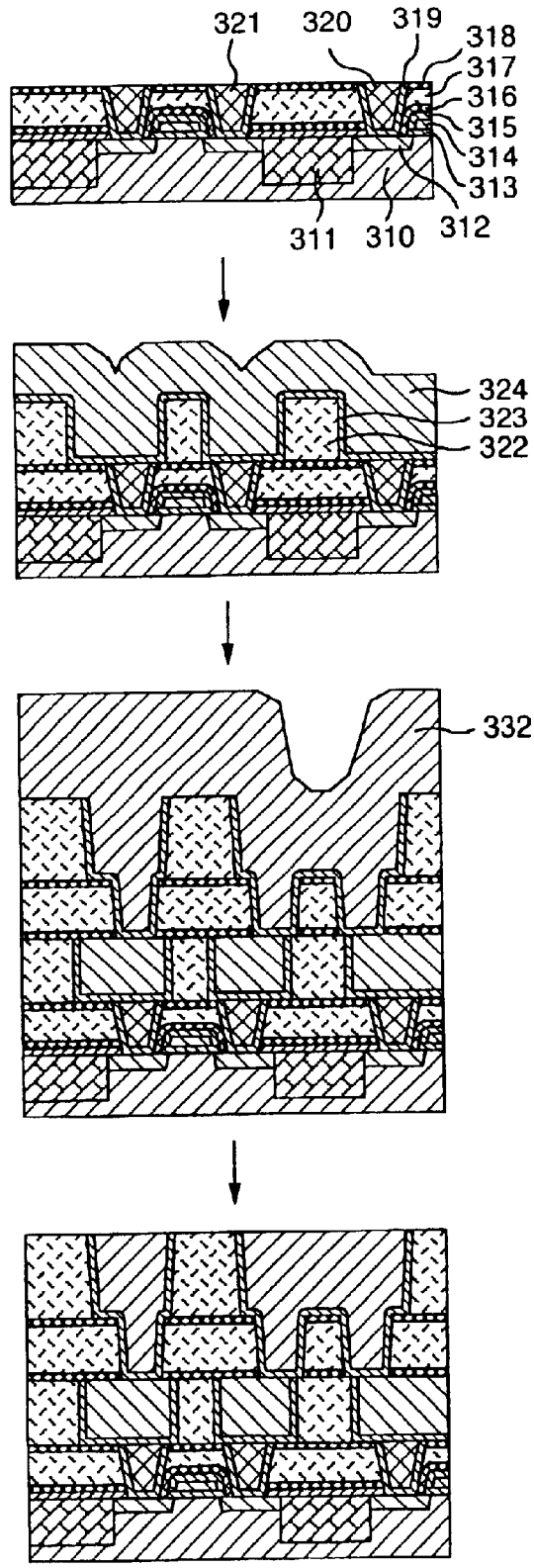
FIG. 3 is another proceeding of polishing on a substrate with electric wires thereon.
Figure 4A:
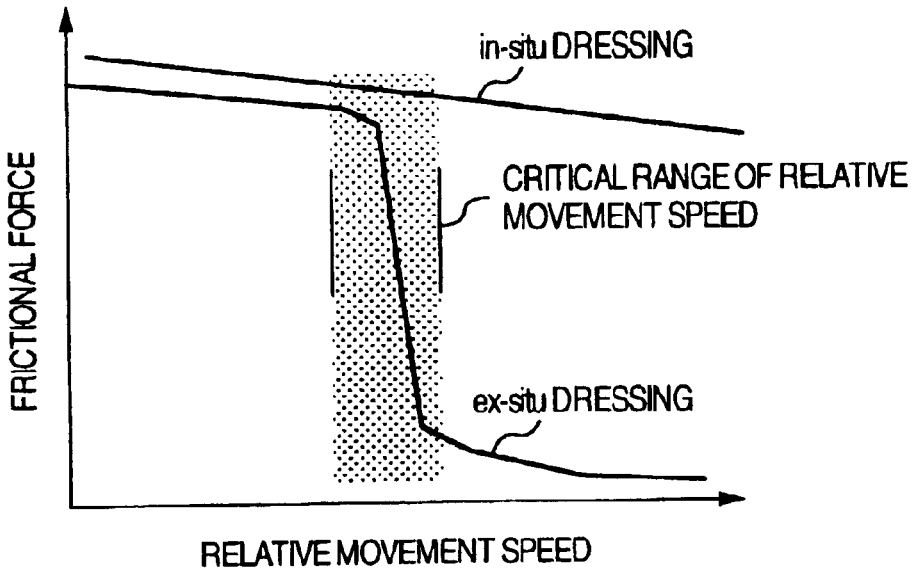
FIG. 4*a* is a diagram showing a relationship between a rotational speed of a polishing pad relative to a surface to be polished and a frictional force between the polishing pad and the surface to be polished, obtained experimentally in each of in-situ dressing (polishing pad surface dressing during polishing operation) and ex-situ dressing (polishing pad surface dressing performed between the polishing operations).
Figure 4B:
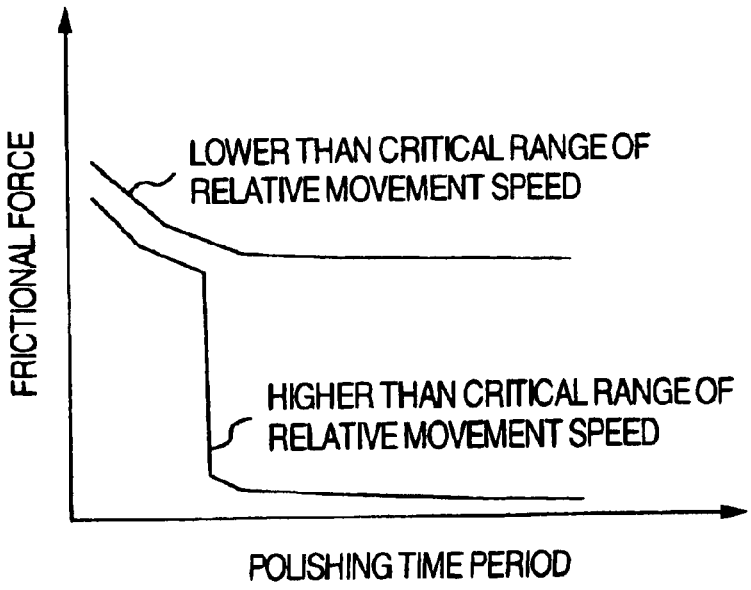
FIG. 4*b* is a diagram between a relationship between an elapsed time of the polishing operation after start of conditioning or dressing of the polishing pad surface and the frictional force between the polishing pad and the surface to be polished, obtained experimentally in each of the rotational speed of the polishing pad lower than a critical relative movement velocity range and the rotational speed of the polishing pad higher than a critical relative movement velocity range.

In this embodiment, a semiconductor integrated circuit (IC) substrate is polished to form an exposed wire thereon as shown in FIG. 3. The substrate may further include a capacitor for a dynamic random access memory. The rotational speed of the platen of 18 inches outer diameter is 60 rpm, the pressure between the substrate surface and the polishing pad surface is 200 gf/cm$^2$, the flow rate of abrasive-grain-free polishing liquid is 0.1 liter/minute, the polishing pad (IC1000, product of Rodel inc.,) is made of the foamed polyurethane polymer, and a temperature of the polishing pad is 22° C.

In a substrate to be polished, an isolation layer 311 is embedded in a substrate base 310 of 6 inches silicon wafer including P-type dopant to divide electric circuits on the substrate into a plurality of electric devices, and a surface of the substrate is flattened by polishing with an alkaline polishing agent including silica and ammonia. A diffusion layer 312 of N-type dopant is formed thereon by thermal treatment or ion-implantation, and a gate isolation layer 313 is formed thereon by thermal oxidizing process. A gate 314-made of polycrystal silicon or a stack of a high-melting-temperature-metal-or-alloy layer and a polycrystal silicon layer is formed thereon. The gate 314 is covered by a device protecting layer 315 including a silicon oxide or a phosphorated silicon oxide and by a contamination protecting layer 316 including a silicon nitride. A flattening layer 317 of silicon oxide (p-TEOS) of about 1.5 $\mu$m thickness is formed thereon through a plasma chemical vapor phase epitaxy deposition (plasma CVD) process using tetraethoxysilane (TEOS), and is polished by about 0.8 $\mu$m thickness to be flattened by a publicly known polishing. The flattened surface is covered by a second protective layer 318 made of silicon nitride to prevent CU from diffusing from the flattened surface. A contact hole 319 for connection to the device is opened at a predetermined position. Thereafter, a stack 320 of a titan layer and a titan nitride layer for adhesiveness and preventing contamination and a tungsten layer 321 are formed on the substrate, and a part thereof on an area other than the contact hole 319 is polished to be removed so that a so-called plug structure is formed.

The stack 320 and the tungsten layer 321 may be formed by a reactive sputtering process or plasma CVD process. A diameter of the contact hole 319 is not more than 0.25 μm, and a depth thereof is 0.8–0.9 μm. The contact hole 319 for the dynamic random access memory may have a depth not less than 1 μm. A thickness of the stack 320 is about 50 nm at a flattened area, and a thickness of the tungsten layer 321 is about 0.6 μm to sufficiently fill the contact hole 319 so that a flatness thereof is improved to make the polishing of tungsten. A polishing agent including a polishing component of SSW-2000 (product of Cabot Co.,) including silica grains and an oxidizing agent of hydrogen peroxide is used to polish the tungsten layer 321 and the titan nitride layer. The tungsten layer 321 may be polished by the abrasive powder free polishing liquid of the present invention, and the stack 320 may be polished by the conventional polishing agent including the abrasive solid powder.

Thereafter, as shown in a part (b) of FIG. 3, a first isolation layer 322 of 0.5 μm for wire receiving grooves is formed, and a first lower metallic layer 323 of 50 nm thickness titan nitride and a first upper metallic layer 324 are formed thereon. The wire receiving grooves are formed by a publicly known reactive dry etching, while the second protective layer 318 of silicon nitride acts to stop proceeding of the etching. Since a ratio between an etching proceeding speed through silicon nitride and that through silicon oxide is about 1:5, a thickness of the second protective layer 318 is set at about 10 nm. The first upper metallic layer 324 of CU is deposited by 0.7 μm thickness through a sputtering process, and subsequently heated to about 450° C. so that the first upper metallic layer 324 of CU flows into the grooves formed by the first isolation layer 322.

Thereafter, as shown in a part (c) of FIG. 3, the first upper metallic layer 324 is polished on the apparatus as shown in FIG. 1. If the contact hole 319 should be prevented from being contaminated by Cu, another polishing apparatus other than the polishing apparatus used for polishing the plug structure may be used. The first lower metallic layer 323 is polished by a mixture of a polishing agent SSW-2000 (product of Cabot Inc.,) including silica abrasive powder, hydrogen peroxide and BTA of 0.2 wt % on a second polishing apparatus (not shown). When the first lower metallic layer 323 is polished, a stuck structure polishing pad IC1400 (product of Rodel inc.,) of an upper layer of foam polyurethane resin and an lower layer of relatively softer resin. This stuck structure polishing pad is somewhat disadvantageous in flattening in comparison with the above described IC1000 polishing pad because of a relatively smaller hardness, but is effective for restraining a damage (scratch) on the polished surface to increase an efficiency on forming the wire. Since the damage (scratch) is apt to be generated on the polished surface when a strength or rigidity of the substrate surface is decreased by a complex structure of active circuit elements and wires under the surface, the stuck structure polishing pad of the relatively smaller hardness is useful. A second contamination protecting layer 325 of 20 nm thickness silicon nitride is formed on the polished surface through the plasma CVD process.

When various and many active circuit elements are formed in the substrate so that a large and complex surface shape irregularity is formed, the first layer isolation layer 322 is not sufficiently flattened although the flattening layer 317 is polished, so that a shallow and wide recess of, for example, about 5 nm thickness and about 5 μm width, remains thereon. If a characteristic of the abrasive grain free polishing liquid is excellent and prevents a generation of dishing, the first upper metallic layer 324 remains in the shallow and wide recess. In order to remove the first upper metallic layer 324 in the shallow and wide recess with the polishing of the first lower metallic layer 323, the mixture of the polishing agent SSW-2000, hydrogen peroxide and BTA in which the concentration of BTA is adjusted to remove the first upper metallic layer 324 in a certain degree is usable.

Thereafter, a second isolation layer 326 of 0.7 μm thickness p-TEOS is formed on the polished surface, and a surface of the second isolation layer 326 is polished by 0.2 μm thickness to be flattened by the above described alkaline polishing agent, so that an irregularity formed by the polishing on the first upper metallic layer 324 is flattened. A contamination protecting layer 327 of 0.2 μm thickness silicon nitride is formed thereon through the plasma CVD process, and subsequently a third isolation layer 328 of 0.7 μm thickness p-TEOS is formed. A connection hole 329 and a second groove 330 are formed through a publicly known photolithography technique and reactive dry etching to expose a part of the first upper metallic layer 324. The layer 327 of silicon nitride is effective as a stopper of etching when these stacked grooves are formed. A second lower metallic layer 331 of 50 nm thickness titan nitride is formed in the groove through the plasma CVD process.

Thereafter, a second upper metallic layer 332 of 1.2 μm thickness Cu is formed on the substrate through a sputtering process, and is heated to 450° C. so that the second upper metallic layer 332 flows into the groove. An upper surface of the second upper metallic layer 332 is polished by the abrasive powder free polishing liquid from the polishing liquid supplier 15 for 5 minutes corresponding to an about −20% excessive polishing, and an exposed upper surface of the second lower metallic layer 331 is polished by the above described polishing agent including SSW-2000 and hydrogen peroxide at a polishing depth increasing rate of about 200 nm/minute so that a stack of double Cu wires by a damascene or dual damascene process is formed as shown in apart (d) of FIG. 3. The polishing conditions other than the polishing time period for the second upper and lower metallic layers are equal to those for the first upper and lower metallic layers.

Embodiment 5

Figure 1B:
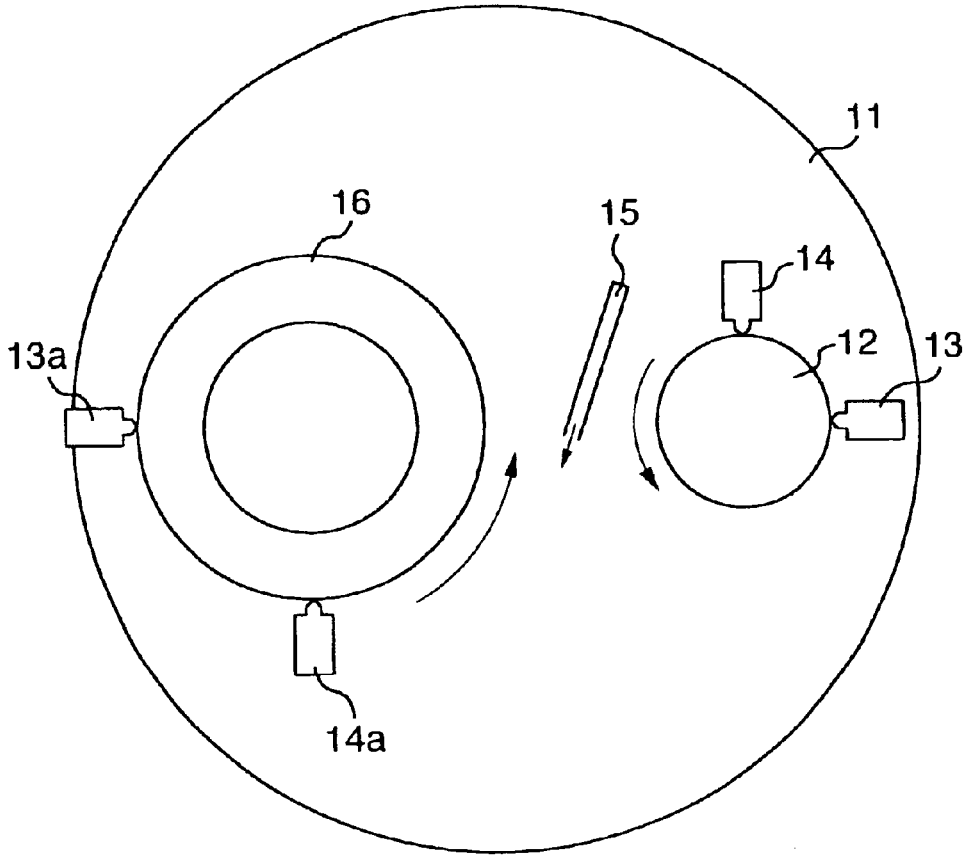
FIG. 1*b* is a front view showing the polishing apparatus usable for carrying out the present invention.

In the polishing apparatus as shown in FIGS. 1*a* and 1*b*, a pressing force or pressure of the carrier 12 against the polishing pad 11 is F1, and a pressing force or pressure of the rotational dressing tool 16 against the polishing pad 11 is F2. A sensor 13*a* detects a radial force applied to the dressing tool 16, and a sensor 14*a* detects a circumferential force applied to the dressing tool 16. A sensor 13 detects a radial force applied to the carrier 12, and a sensor 14 detects a circumferential force applied to the carrier 12. The sensors detect or support respective (preferably, circumferential and/or radial) components of the frictional forces applied respectively to the carrier 12 and dressing tool 16. The polishing pad 12 is a stack type pad of a hard foamed fluoro-carbon polymer polishing pad IC1000 (product of Rodel Inc.,) and a non-woven-fabric polishing pad SUBA-IV (product of Rodel Inc.,). The abrasive grain free polishing liquid including the DL-malic acid for dissolving the oxidized surface part, BTA for forming the protective layer resistant against oxidizing, hydrogen peroxide for oxidizing the surface part and a surfactant is supplied onto the polishing pad surface by about 50 ml/minute during the polishing, and the dressing tool 16 is pressed against the polishing pad surface with 50 gf/cm$^2$ during the polishing.

When a number of the substrates 100 polished under the same polishing conditions as the embodiment 2 reaches 300, the detected circumferential component of the frictional force applied to the dressing tool 16 decreases from an original value of about 30 gf/cm$^2$ at a start of the polishing to about 20 gf/cm$^2$, and a polishing depth increasing rate through CU layer on the substrate decreases by 20% in comparison with an original value thereof at the start of the polishing. By increasing the pressing force or pressure F2 of the rotational dressing tool 16 against the polishing pad 11 to 80 gf/cm$^2$, the detected circumferential component of the frictional force applied to the dressing tool 16 returns to 35 gf/cm$^2$, and the polishing depth increasing rate through CU layer on the substrate returns to the original value thereof at the start of the polishing. When the pressing force or pressure F2 of the rotational dressing tool 16 against the polishing pad 11 necessary for returning the frictional force applied to the dressing tool 16 to the original value thereof at the start of the polishing reaches a predetermined degree, the polishing pad 11 is replaced by new one.

The pressing force or pressure F2 of the rotational dressing tool 16 against the polishing pad 11 may be increased so that the detected frictional force applied to the carrier 12 is kept within a predetermined range, and pressing force or pressure F2 of the rotational dressing tool 16 against the polishing pad 11 may be increased so that the detected frictional force applied to the dressing tool 16 is kept within a predetermined range. The predetermined range is obtained by experimentally and/or experientially.

As disclosed in the specification of Japanese Patent Application No. Hei 9–299937, abrasive grain-free abrasive materials contain acids for etching oxide layer on the metal surface (hereinafter referred to as "oxide etchant"), protective layer-forming agents for forming a protective layer on the surface of metal film, oxidizing agents, etc. As the oxide etchants, suitable are DL-malic acid, formic acid, acetic acid, propionic acid, butyric acid, valeric acid, 2-methylbutyric acid, n-hexanoic acid, 3,3-dimethylbutyric acid, 2-ethylbutyric acid, 4-methylpentanoic acid, n-heptanoic acid, 2-methylhexanoic acid, n-octanoic acid, 2-ethylhexanoic acid, benzoic acid, glycollic acid, salicylic acid, glyceric acid, oxalic acid, malonic acid, succinic acid, glutaric acid, adipic acid, pimelic acid, maleic acid, phthalic acid, malic acid, tartaric acid and citric acid, and salts thereof, sulfuric acid, nitric acid, phosphoric acid, ammonia, ammonium salts, or mixtures thereof. The present invention is not limited to these examples. Especially preferred are benzoic acid, oxalic acid, malonic acid, succinic acid, adipic acid, pimelic acid, maleic acid, phthalic acid, malic acid, tartaric acid and citric acid, and salts thereof, or mixtures thereof. As the protective layer-forming agents, mention may be made of one or more agents selected from benzotriazole (hereinafter referred to as "BTA"), BTA derivatives, for example, those which are obtained by substituting a methyl group for one hydrogen atom in benzene ring of BTA (tolyltriazole) or those which are obtained by substituting a carboxyl group or the like for the hydrogen atom (benzotriazole-4-carboxylic acid, and methyl, ethyl, propyl, butyl and octyl esters thereof), or naphthotriazole, naphthotriazole derivatives (those which are obtained by substituting a methyl group, a carboxyl group or the like for one hydrogen atom of naphthalene ring), and mixtures thereof, and polymers containing a monomer having carboxylic acid, such as polyacrylic acid, polymethacrylic acid, ammonium polymethacrylate, sodium polymethacrylate, polyamic acid, ammonium salt of polyamic acid and sodium salt of polyamic acid. As the oxidizing agents, hydrogen peroxide, nitric acid, ferric nitrate, potassium periodate, etc. are suitable.

Figure 6:
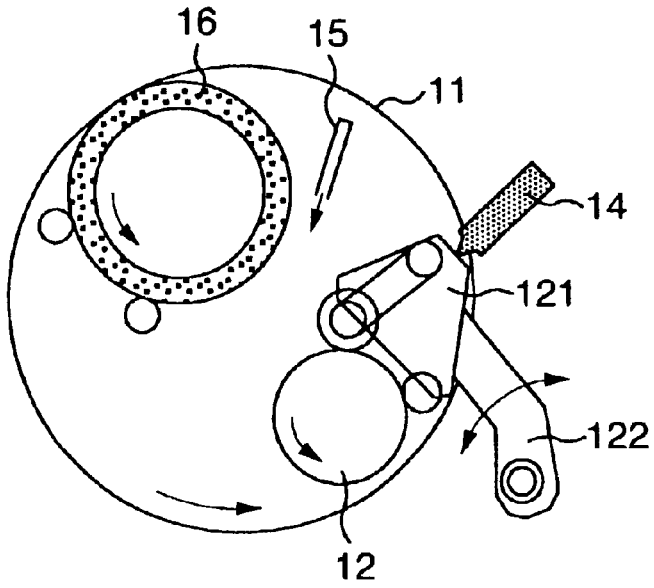
FIG. 6 is a front view showing another polishing apparatus usable for carrying out the present invention.

In another polishing apparatus of the present invention as shown in FIG. 6, the carrier 12 movable parallel to the polishing pad surface of the polishing pad 11 is supported in a rotatable manner on a holder 121 connected to a swing arm 122 swingable around an axis parallel to the rotational axis of the platen 10. The swing movement of the holder 121 is restrained by a load cell 14 to measure an urging force applied to the carrier 12 along the polishing pad 11, that is, the frictional force the polishing pad 11 and the substrate surface to be polished under the carrier 12.

What is claimed is:

1. A method for producing a substrate having a substrate surface, by polishing the substrate surface which includes a metallic wire, comprising the steps of:

supplying a polishing liquid to a clearance between the substrate surface and a polishing pad surface of a polishing pad, which polishing liquid includes an acid for dissolving an oxidized part of the substrate surface and is prevented substantially from including solid abrasive powder, generating a relative movement between the substrate surface and the polishing pad surface while pressing the substrate surface against the polishing pad surface with the polishing liquid between the substrate surface and the polishing pad surface so that the dissolved oxidized part of the substrate surface is removed from the substrate, and sliding a stirring member on the polishing pad surface so that the polishing liquid is stirred.

2. A method according to claim 1, wherein the polishing liquid is stirred in a direction perpendicular to a direction of the relative movement so that the concentration of dissolved oxidized part of the substrate surface in the polishing liquid is made uniform in the direction perpendicular to the direction of the relative movement.

3. A method according to claim 2, wherein the polishing pad rotates on a rotational axis, and a stirring member slides radially inward on the polishing pad surface.

4. A method according to claim 2, wherein the polishing pad rotates on a rotational axis, and a stirring member slides radially outward on the polishing pad surface.

5. A method according to claim 1, wherein the polishing liquid is stirred in a direction perpendicular to a direction of the relative movement so that the acidity of the polishing liquid is made uniform in the direction perpendicular to the direction of the relative movement.

6. A method according to claim 5, wherein the polishing pad rotates on a rotational axis, and a stirring member slides radially inward on the polishing pad surface.

7. A method according to claim 5, wherein the polishing pad rotates on a rotational axis, and a stirring member slides radially outward on the polishing pad surface.

8. A method according to claim 1, wherein the stirring member is prevented substantially from grinding the polishing pad surface when the stirring member slides on the polishing pad surface to stir the polishing liquid.

9. A method according to claim 1, wherein the stirring member slides on the polishing pad surface to stir the polishing liquid in a direction perpendicular to a direction of the relative movement, and the polishing liquid in which a concentration of the dissolved oxidized part of the substrate surface is smaller than a concentration of the dissolved oxidized part of the substrate surface in the polishing liquid on the polishing pad surface is supplied into the clearance between the substrate surface and the polishing pad surface after being stirred by the stirring member to be mixed with the polishing liquid on the polishing pad surface, when the polishing liquid in which the concentration of the dissolved oxidized part of the substrate surface is smaller than the concentration of the dissolved oxidized part of the substrate surface in the polishing liquid on the polishing pad surface is added and supplied into the polishing liquid on the polishing pad surface.

10. A method according to claim 1, wherein the stirring member slides on the polishing pad surface to stir the polishing liquid in a direction perpendicular to a direction of the relative movement, and the polishing liquid in which a concentration of the dissolved oxidized part of the substrate surface is smaller than a concentration of the dissolved oxidized part of the substrate surface in the polishing liquid on the polishing pad surface is supplied into the clearance between the substrate surface and the polishing pad surface before being stirred by the stirring member and subsequently is stirred by the stirring member to be mixed with the polishing liquid on the polishing pad surface after passing through the clearance between the substrate surface and the polishing pad surface, when the polishing liquid in which the concentration of the dissolved oxidized part of the substrate surface is smaller than the concentration of the dissolved oxidized part of the substrate surface in the polishing liquid on the polishing pad surface is added and supplied into the polishing liquid on the polishing pad surface.

11. A method according to claim 1, wherein the stirring member slides on the polishing pad surface to stir the polishing liquid in a direction perpendicular to a direction of the relative movement, and the polishing liquid whose acidity is larger than an acidity of the polishing liquid on the polishing pad surface is supplied into the clearance between the substrate surface and the polishing pad surface after being stirred by the stirring member to be mixed with the polishing liquid on the polishing pad surface, when the polishing liquid whose acidity is larger than the acidity of the polishing liquid on the polishing pad surface is added and supplied into the polishing liquid on the polishing pad surface.

12. A method according to claim 1, wherein the stirring member slides on the polishing pad surface to stir the polishing liquid in a direction perpendicular to a direction of the relative movement, and the polishing liquid whose acidity is larger than an acidity of the polishing liquid on the polishing pad surface is supplied into the clearance between the substrate surface and the polishing pad surface before being stirred by the stirring member and subsequently is stirred by the stirring member to be mixed with the polishing liquid on the polishing pad surface after passing through the clearance between the substrate surface and the polishing pad surface, when the polishing liquid whose acidity is larger than the acidity of the polishing liquid on the polishing pad surface is added and supplied into the polishing liquid on the polishing pad surface.

13. A method according to claim 1, wherein the polishing liquid includes the abrasive powder of not more than 0.5 weight percent.

14. A method according to claim 1, wherein the polishing liquid includes the abrasive powder of not more than 0.1 weight percent.

15. A method according to claim 1, wherein a surfactant is added and supplied into the polishing liquid on the polishing pad surface so that a volume of the surfactant on the polishing pad surface is increased.

16. A method according to claim 15, wherein the relative movement between the substrate surface and the polishing pad surface is being generated, when the surfactant is added and supplied into the polishing liquid on the polishing pad surface.

17. A method according to claim 15, wherein the substrate surface is prevented from contacting the polishing pad surface, when the surfactant is added and supplied into the polishing liquid on the polishing pad surface.

18. A method according to claim 1, wherein the stirring member slides on the polishing pad surface to stir the polishing liquid in a direction perpendicular to a direction of the relative movement, and a surfactant is supplied into the clearance between the substrate surface and the polishing pad surface after being stirred by the stirring member to be mixed with the polishing liquid on the polishing pad surface, when the surfactant is added and supplied into the polishing liquid on the polishing pad surface.

19. A method according to claim 1, wherein the stirring member slides on the polishing pad surface to stir the polishing liquid in a direction perpendicular to a direction of the relative movement, and the surfactant is supplied into the clearance between the substrate surface and the polishing pad surface before being stirred by the stirring member and subsequently is stirred by the stirring member to be mixed with the polishing liquid on the polishing pad surface after passing through the clearance between the substrate surface and the polishing pad surface, when the surfactant is added and supplied into the polishing liquid on the polishing pad surface.

20. An apparatus for producing a substrate having a substrate surface, by polishing the substrate surface including a metallic wire, comprising, polishing pad holder for holding a polishing pad including a polishing pad surface for polishing the substrate surface, the polishing pad holder being movable relative to the substrate surface to generate a relative movement between the substrate surface and the polishing pad surface, a polishing liquid supplier for supplying a polishing liquid to a clearance between the substrate surface and the polishing pad surface, which polishing liquid includes an acid for dissolving an oxidized part of the substrate surface and is prevented substantially from including solid abrasive powder, a pressure generator for pressing the substrate surface against the polishing pad surface with the polishing liquid between the substrate surface and the polishing pad surface during the relative movement, and a stirring member slidable on the polishing pad surface so that the polishing liquid is stirred.

21. An apparatus according to claim 20, wherein the stirring member is movable in a direction perpendicular to a direction of the relative movement, and wherein the polishing liquid is stirred in the direction perpendicular to the direction of the relative movement by the stirring member so that the concentration of dissolved oxidized part of the substrate surface in the polishing liquid is made uniform in the direction perpendicular to the direction of the relative movement.

22. An apparatus according to claim 21, wherein the polishing pad is rotatable on a rotational axis, and the stirring member is movable to slide radially inward on the polishing pad surface.

23. An apparatus according to claim 21, wherein the polishing pad is rotatable on a rotational axis, and the stirring member is movable to slide radially outward on the polishing pad surface.

24. An apparatus according to claim 20, wherein the stirring member is movable in a direction perpendicular to a direction of the relative movement, wherein the polishing liquid is stirred by the stirring member in the direction perpendicular to the direction of the relative movement so that the acidity of the polishing liquid is made uniform in the direction perpendicular to the direction of the relative movement.

25. An apparatus according to claim 24, wherein the polishing pad is rotatable on a rotational axis, and the stirring member is movable to slide radially inward on the polishing pad surface.

26. An apparatus according to claim 24, wherein the polishing pad is rotatable on a rotational axis, and the stirring member is movable to slide radially outward on the polishing pad surface.

27. An apparatus according to claim 20, wherein the stirring member is movable relative to the polishing pad holder, wherein the stirring member is prevented substantially from grinding the polishing pad surface when the stirring member slides on the polishing pad surface to stir the polishing liquid.

28. An apparatus according to claim 20, wherein the stirring member slides on the polishing pad surface to stir the polishing liquid in a direction perpendicular to a direction of the relative movement, wherein the stirring member is arranged relative to the polishing liquid supplier in the direction of the relative movement in such a manner that the polishing liquid supplied by the polishing liquid supplier in which liquid a concentration of the dissolved oxidized part of the substrate surface is smaller than concentration of the dissolved oxidized part of the substrate surface in the polishing liquid on the polishing pad surface is stirred by the stirring member to be mixed with the polishing liquid on the polishing pad surface and subsequently proceeds into the clearance between the substrate surface and the polishing pad surface.

29. An apparatus according to claim 20, wherein the stirring member slides on the polishing pad surface to stir the polishing liquid in a direction perpendicular to a direction of the relative movement, wherein the stirring member is arranged relative to the polishing liquid supplier in the direction of the relative movement in such a manner that the polishing liquid supplied by the polishing liquid supplier in which liquid a concentration of the dissolved oxidized part of the substrate surface is smaller than a concentration of the dissolved oxidized part of the substrate surface in the polishing liquid on the polishing pad surface proceeds into the clearance between the substrate surface and the polishing pad surface and subsequently is stirred by the stirring member to be mixed with the polishing liquid on the polishing pad surface after passing through the clearance between the substrate surface and the polishing pad surface.

30. An apparatus according to claim 20, wherein the stirring member slides on the polishing pad surface to stir the polishing liquid in a direction perpendicular to a direction of the relative movement, wherein the stirring member is arranged relative to the polishing liquid supplier in the direction of the relative movement in such a manner that the polishing liquid supplied by the polishing liquid supplier acidity of which liquid is larger than an acidity of the polishing liquid on the polishing pad surface is stirred by the stirring member to be mixed with the polishing liquid on the polishing pad surface and-subsequently proceeds into the clearance between the substrate surface and the polishing pad surface.

31. An apparatus according to claim 20, wherein the stirring member slides on the polishing pad surface to stir the polishing liquid in a direction perpendicular to a direction of the relative movement, wherein the stirring member is arranged relative to the polishing liquid supplier in the direction of the relative movement in such a manner that the polishing liquid supplied by the polishing liquid supplier acidity of which liquid is larger than an acidity of the polishing liquid on the polishing pad surface proceeds into the clearance between the substrate surface and the polishing pad surface and subsequently is stirred by the stirring member to be mixed with the polishing-liquid on the polishing pad surface after passing through the clearance between the substrate surface and the polishing pad surface.

32. An apparatus according to claim 20, wherein the polishing liquid includes the abrasive powder of not more than 0.5 weight percent.

33. An apparatus according to claim 20, wherein the polishing liquid includes the abrasive powder of not-more than 0.1 weight percent.

34. An apparatus according to claim 20, wherein the polishing liquid supplier is adapted to add and supply a surfactant into the polishing liquid on the polishing pad surface so that a volume of the surfactant on the polishing pad surface is increased.

35. An apparatus according to claim 34, wherein the relative movement between the substrate surface and the polishing pad surface is being generated, when the surfactant is added and supplied by the polishing liquid supplier into the polishing liquid on the polishing pad surface.

36. An apparatus according to claim 34, wherein the substrate surface is prevented from contacting the polishing pad surface, when the surfactant is added and supplied by the polishing liquid supplier into the polishing liquid on the polishing pad surface.

37. An apparatus according to claim 20, wherein the stirring member slides on the polishing pad surface to stir the polishing liquid in a direction perpendicular to a direction of the relative movement, wherein the polishing liquid supplier is adapted to add and supply a surfactant into the polishing liquid on the polishing pad surface, and the stirring member is arranged relative to the polishing liquid supplier in the direction of the relative movement in such a manner that the surfactant supplied by the polishing liquid supplier is stirred by the stirring member to be mixed with the polishing liquid on the polishing pad surface and subsequently proceeds into the clearance between the substrate surface and the polishing pad surface.

38. An apparatus according to claim 20, wherein the stirring member slides on the polishing pad surface to stir the polishing liquid in a direction perpendicular to a direction of the relative movement, wherein the polishing liquid supplier is adapted to add and supply a surfactant into the polishing liquid on the polishing pad surface, and the surfactant supplied by the polishing liquid supplier proceeds into the clearance between the substrate surface and the polishing pad surface and subsequently is stirred by the stirring member to be mixed with the polishing liquid on the polishing pad -surface after passing through the clearance between the substrate surface and the polishing pad surface.

39. A method for producing a substrate having a substrate surface by polishing the substrate surface, which includes a metallic wire, comprising the steps of:

supplying a polishing liquid to a clearance between the substrate surface and a polishing pad surface of a polishing pad, which polishing liquid includes an acid for dissolving an oxidized part of the substrate surface and is prevented substantially from including solid abrasive powder, and generating a relative movement between the substrate surface and the polishing pad surface while pressing the substrate surface against the polishing pad surface with the polishing liquid between the substrate surface and the polishing pad surface so that the dissolved oxidized part of the substrate surface is removed from the substrate, wherein a surfactant is added and supplied into the polishing liquid on the polishing pad surface so that a volume of the surfactant on the polishing pad surface is increased wherein the relative movement between the substrate surface and the polishing pad surface is being generated, when the surfactant is added and supplied into the polishing liquid on the polishing pad surface.

40. A method for producing a substrate having a substrate surface by polishing the substrate surface, which includes a metallic wire, comprising the steps of:

supplying a polishing liquid to a clearance between the substrate surface and a polishing pad surface of a polishing pad, which polishing liquid includes an acid for dissolving an oxidized part of the substrate surface and is prevented substantially from including solid abrasive powder, and generating a relative movement between the substrate surface and the polishing pad surface while pressing the substrate surface against the polishing pad surface with the polishing liquid between the substrate surface and the polishing pad surface so that the dissolved oxidized part of the substrate surface is removed from the substrate, wherein a surfactant is added and supplied into the polishing liquid on the polishing pad surface so that a volume of the surfactant on the polishing pad surface is increased wherein the substrate surface is prevented from contacting the polishing pad surface, when the surfactant is added and supplied into the polishing liquid on the polishing pad surface.

41. An apparatus for producing a substrate having a substrate surface by polishing the substrate surface, which includes a metallic wire, comprising, a polishing pad holder for holding a polishing pad including a polishing pad surface for polishing the substrate surface, the polishing pad holder being movable relative to the substrate surface to generate a relative movement between the substrate surface and the polishing pad surface, a polishing liquid supplier for supplying a polishing liquid to a clearance between the substrate surface and the polishing pad surface, which polishing liquid includes an acid for dissolving an oxidized part of the substrate surface and is prevented substantially from including solid abrasive powder, and a pressure generator for pressing the substrate surface against the polishing pad surface with the polishing liquid between the substrate surface and the polishing pad surface during the relative movement, wherein the polishing liquid supplier is adapted to add and supply a surfactant into the polishing liquid on the polishing pad surface so that a volume of the surfactant on the polishing pad surface is increased, and wherein the relative movement between the substrate surface and the polishing pad surface is being generated, when the surfactant is added and supplied by the polishing liquid supplier into the polishing liquid on the polishing pad surface.

42. An apparatus for producing a substrate having a substrate surface by polishing the substrate surface, which includes a metallic wire, comprising, a polishing pad holder for holding a polishing pad including a polishing pad surface for polishing the substrate surface, the polishing pad holder being movable relative to the substrate surface to generate a relative movement between the substrate surface and the polishing pad surface, a polishing liquid supplier for supplying a polishing liquid to a clearance between the substrate surface and the polishing pad surface, which polishing liquid includes an acid for dissolving an oxidized part of the substrate surface and is prevented substantially from including solid abrasive powder, and a pressure generator for pressing the substrate surface against the polishing pad surface with the polishing liquid between the substrate surface and the polishing pad surface during the relative movement, wherein the polishing liquid supplier is adapted to add and supply a surfactant into the polishing liquid on the polishing pad surface so that a volume of the surfactant on the polishing pad surface is increased, and wherein the substrate surface is prevented from contacting the polishing pad surface, when the surfactant is added and supplied by the polishing liquid supplier into the polishing liquid on the polishing pad surface.

* * * * *